US005661897A

United States Patent [19]

Kaneda et al.

[11] Patent Number: 5,661,897

[45] Date of Patent: Sep. 2, 1997

[54] APPLICATOR FOR TERMINAL CRIMPING MACHINE

[75] Inventors: Hideyuki Kaneda; Yoshiaki Nomoto, both of Shizuoka, Japan

[73] Assignee: Yazaki Corporation, Tokyo, Japan

[21] Appl. No.: 594,493

[22] Filed: Jan. 31, 1996

[30] Foreign Application Priority Data

Feb. 9, 1995 [JP] Japan ..... 7-021695

[51] Int. Cl.[6] ..... H01R 43/055

[52] U.S. Cl. ..... 29/753; 29/33 M; 29/751; 29/755; 29/863; 72/712

[58] Field of Search ..... 29/33 M, 751, 29/753, 755, 759, 761, 863; 72/409.06, 409.14, 413, 712

[56] References Cited

U.S. PATENT DOCUMENTS

| | | | |
|---|---|---|---|
| 4,554,725 | 11/1985 | Over et al. | 29/33 M X |
| 4,574,440 | 3/1986 | Wirth et al. | 29/33 M X |
| 5,110,255 | 5/1992 | LeBan et al. | 29/753 X |
| 5,127,159 | 7/1992 | Kudo et al. | 29/753 X |
| 5,404,634 | 4/1995 | Takeshita et al. | 29/33 M X |

FOREIGN PATENT DOCUMENTS

| | | |
|---|---|---|
| 60-024232 | 2/1985 | Japan . |
| 6-36854 | 2/1994 | Japan . |
| 7-57848 | 3/1995 | Japan . |

*Primary Examiner*—Peter Vo

*Attorney, Agent, or Firm*—Armstrong, Westerman, Hattori, McLeland & Naughton

[57] ABSTRACT

An applicator is provided for removably mounting on a terminal crimping machine. The applicator includes: a terminal crimping member having a crimping anvil and a crimping jig; a terminal supply member having a terminal shifting mechanism; a terminal reel member for taking up crimped terminals on a take-up line wound around said terminal reel member; and a reel stand member for supporting the terminal reel. All the members are integrally arranged on a base plate.

11 Claims, 6 Drawing Sheets

APPLICATOR FOR TERMINAL CRIMPING MACHINE

BACKGROUND OF THE INVENTION

1. Field of the Invention

The present invention relates to an applicator to be mounted in a terminal crimping machine for crimping an electric wire on a terminal by caulking in a process of fabricating a wiring harness used for electric wiring for a vehicle.

2. Description of the Prior Art

In recent years, the production of wiring harnesses used in electric wiring for a motor vehicle is likely to shift from a mass-production system to a small quantity and a variety of kinds of production systems. A wire end processing system has been required which can implement a series of processing inclusive of caulking and crimping of a large number of kinds of wires having several standards (wire diameter, single or multiple, twisted or non-twisted, covering color) and lengths on different terminals. Japanese Patent Preliminary Publication No. 6-38854 proposes a wire end processing system as shown in FIG. 6.

The electric wire end processing system includes an electric wire supply device P, an inverting device Q, a cutting device R, a transporting device S, a peeling device T, a terminal crimping unit U and an automatic control device V for controlling these devices.

Of these devices, the terminal crimping unit U serves to crimp a required terminal on the conductive end conductor of a wire. As shown in FIG. 7, the terminal crimping unit U includes a terminal crimping machine c mounted on a supporting stand b attached on a stand a.

The terminal crimping machine c includes an applicator d having a crimping die corresponding to a predetermined terminal and a terminal shifting mechanism. Chain-like terminals f wound around a terminal reel e, attached on the shaft of the stand a are supplied, one by one, to the crimping die of the applicator d through the terminal guide so as to be crimped on the end of the electric wire.

The chain-like terminals are so formed by pressing so that plural terminals are coupled to make a continuous band and held in a state where they are wound around the terminal reel e.

The wire end processing system requires the following steps (a) to (f) in replacement of the part number of terminals:

(a) removing a terminal f from the applicator d of the terminal crimping unit U;

(b) taking out a redundant terminal f to the terminal reel e and removing it from the stand a;

(c) removing the applicator from the terminal crimping machine;

(d) mounting an applicator d' to be newly used in the terminal crimping machine c;

(e) attaching a terminal reel c' to be newly used to the stand a; and (f) setting a new terminal f' guided from the terminal reel e' in the applicator d'.

The above process, which includes several troublesome replacement workings, has the disadvantage of taking a long time to prepare the terminal crimping unit U. In order to shorten the time required for the replacement working, a large number of terminal crimping units U corresponding to a great variety of kinds of wires and terminals which can be prepared previously. However, this leads to cost increase and requires a vast accommodating space, which are obstacles to actual use.

SUMMARY OF THE INVENTION

The present invention has been accomplished in view of the above circumstance.

An object of the present invention is to provide an applicator for a terminal crimping machine which can swiftly implement replacement work for changing the part number of terminals by integrally installing a terminal reel in an applicator to be removably mounted in a terminal crimping machine.

In order to attain the above object, in accordance with the present invention, there is provided an applicator to be removably mounted in a terminal crimping machine comprising:

a terminal crimping member including a crimping anvil and a crimping jig;

a terminal supply member having a terminal shifting mechanism;

a terminal reel member on which or crimped terminals; and a reel stand member for supporting said terminal reel, all of said members being integrally arranged on a base plate.

In accordance with the present invention, since terminals are held in a state where they are set in the terminal crimping member of an applicator, the working attendant to the change in the part number of terminals has only to carry out attachment/removal of the applicator integrated to the terminal reel for a terminal crimping machine.

Therefore, the replacement work such as the change in the part number of terminals can be simplified and completed in a short time. This remarkably improves production performance in process. With several applicators prepared corresponding to several kinds of terminals, they can be immediately replaced in an actual use as required.

The above and other objects and features of the present invention will be more apparent from the following description taken in conjunction with the accompanying drawings.

DESCRIPTION OF THE PREFERRED EMBODIMENTS

Figure 1:
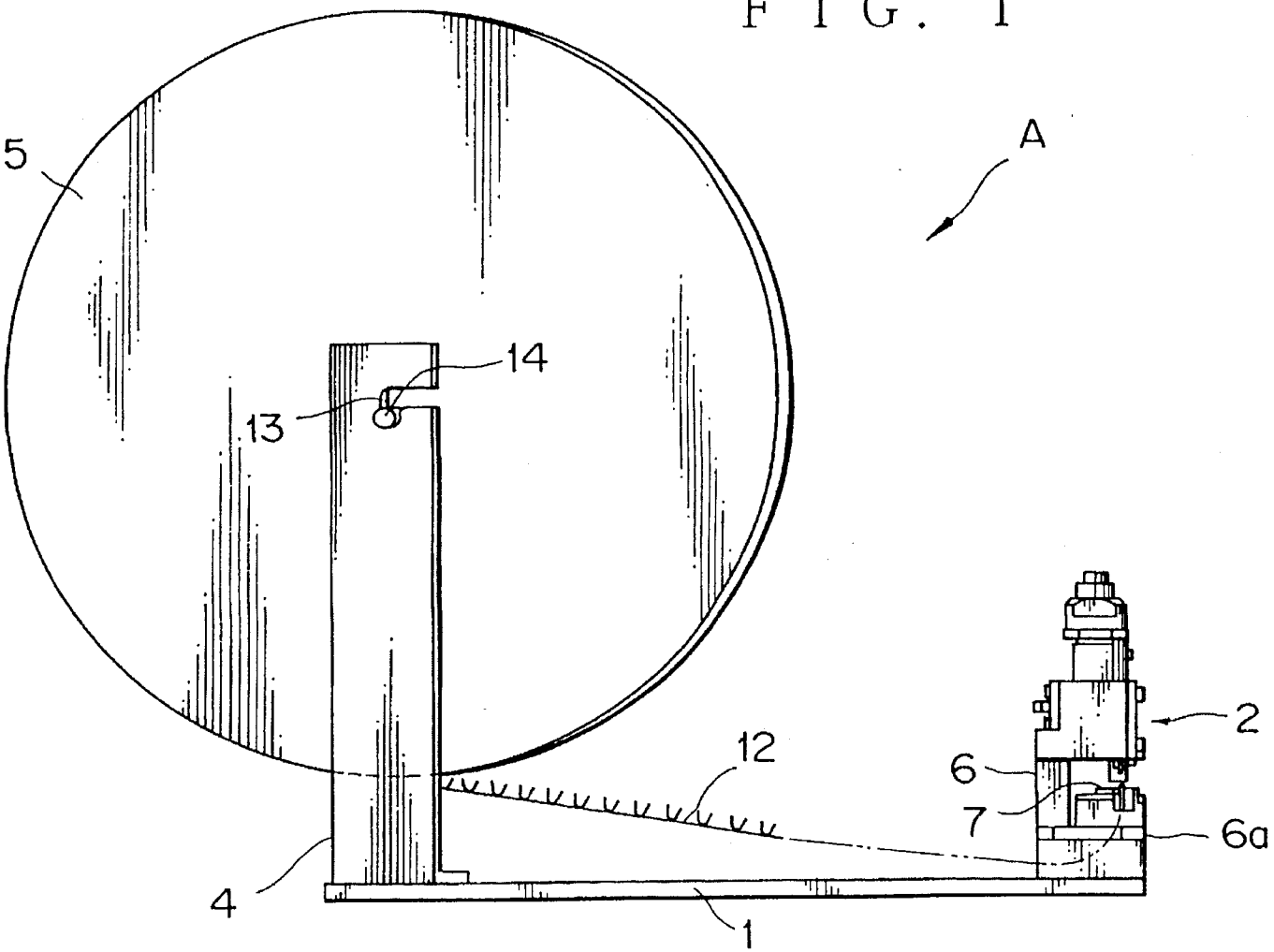
FIG. 1 is a side view of an applicator for a terminal crimping machine according to an embodiment of the present invention.
Figure 2:
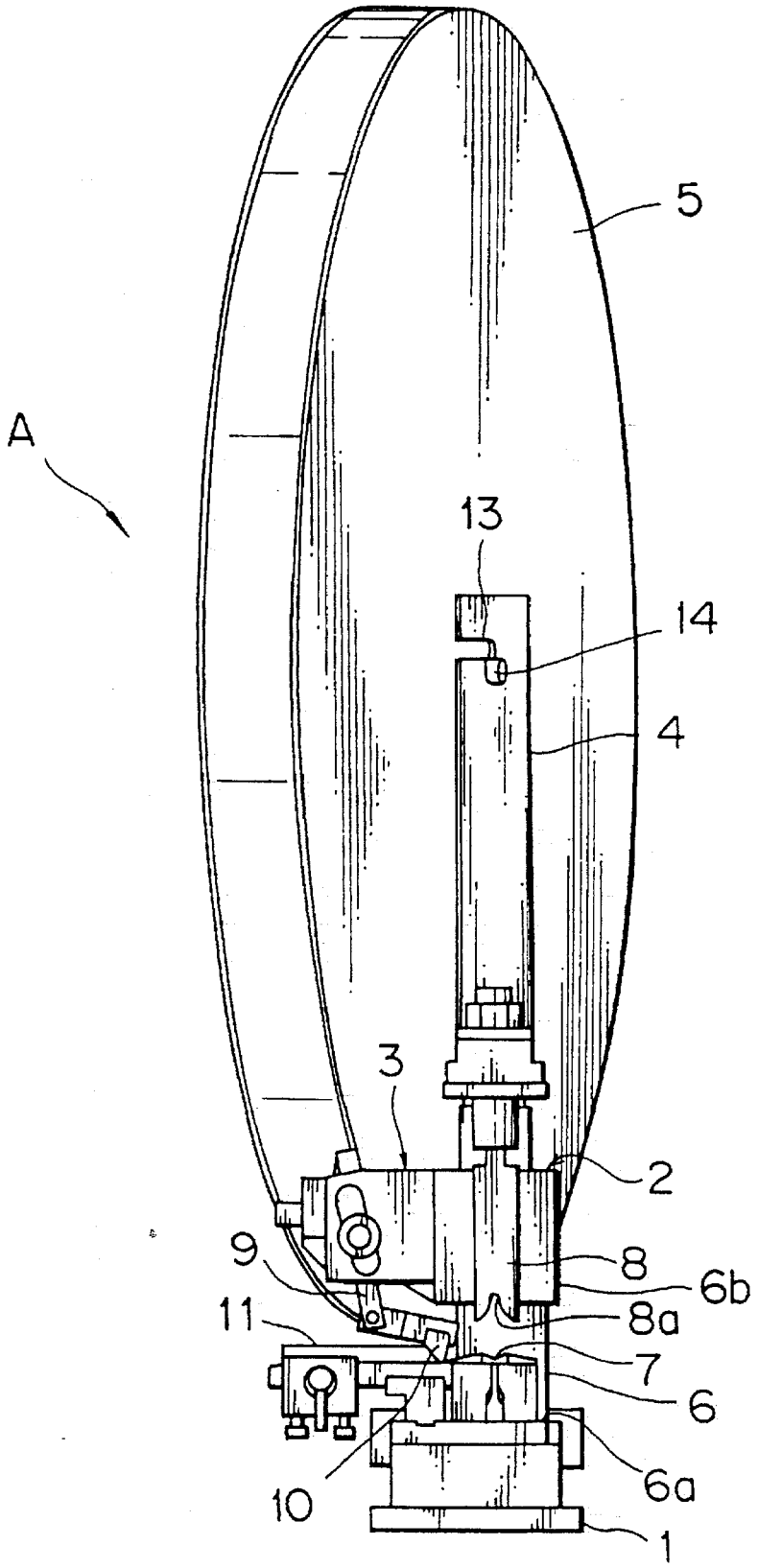
FIG. 2 is a front view of the applicator for the terminal crimping machine shown in FIG. 1.
Figure 3:
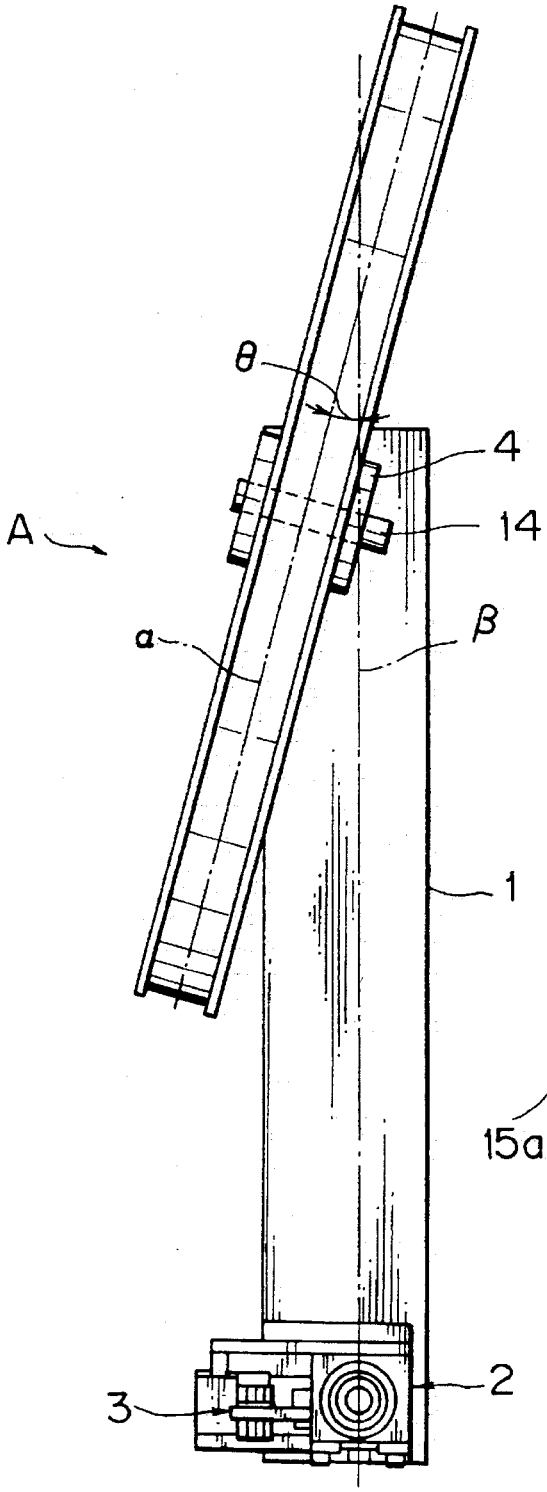
FIG. 3 is a plan view of the applicator for the terminal crimping machine shown in FIG. 1.

FIG. 1 is a side view of an applicator A for a terminal crimping machine according to an embodiment of the present invention; FIG. 2 is a front view thereof; and FIG. 3 is a plan view thereof.

The applicator A for a terminal crimping machine includes a rectangular base plate 1, a terminal crimping member 2 fixed at one end of the base plate 1, a terminal supply member 3 provided integrally to the terminal crimping member 2, a reel stand 4 vertically provided at the other end of the base plate 1, and a terminal reel 5.

The terminal crimping member 2 includes a crimping anvil 7 set on the bottom (lower) portion 6*a* of a ⊐ inverted U-shaped supporting frame 6 and a caulking jig 8 provided in a supporting arm (upper) portion 6*b* so that it can be risen or fallen. A terminal supply member 3 is also coupled with the supporting arm portion 6*b*.

The caulking jig 8, with the caulking member 8*a* at one end being opposite to the crimping anvil 7, serves to caulk the terminal placed on the crimping anvil 7 under the pressing force by a slide drum (not shown) of the terminal crimping machine from above of the other end.

The terminal supply member 3 includes a terminal shifting arm 9 which is freely swingable as a terminal shifting mechanism. The terminal shifting arm 9 is driven in engagement with the rising/falling movement of the caulking jig 8 through a rod (not shown). The terminal shifting arm is coupled with the a shifting piece 10 which hooks the chain-like terminals 12 introduced to the terminal shifting stand 11 and supplies them toward the crimping anvil 7 one by one.

At the upper end of the reel stand 4, a supporting groove 13 which is formed by making shallow cut in the edge of the reel stand 4 is provided. A supporting shaft 14 placed in the groove 13 supports the terminal reel 5 as to be rotatable. The supporting shaft 14 of the terminal reel 5 is so set that the line $\alpha$ of taking out the chain-like or crimped terminals wound around the terminal reel 5 forms a small angle $\theta$ with the line $\beta$ in parallel from the anvil 7 of the terminal crimping portion 2 to the base plate 5 (see FIG. 3). The small angle $\theta$ is set for about 15° in order to satisfy the contradictory requirements of reducing the size of the entire terminal crimping machine and smoothly shifting the chain-like or crimped terminals to the terminal supply member 3. The terminals taken from the terminal reel 5 are shifted out so as to draw an arc having a large curvature. Thus, the terminals can be smoothly supplied to the crimping anvil 7.

Figure 4:
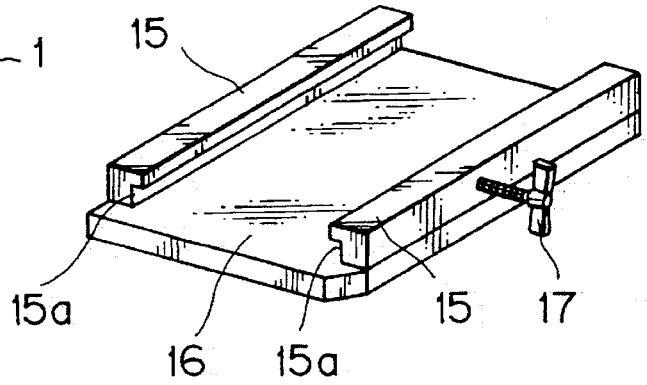
FIG. 4 is a perspective view of a mounting means for removably mounting an applicator for the terminal crimping machine shown in FIG. 1.

The means of mounting the applicator A in the terminal crimping machine should not be limited particularly. The partner device may have a structure as shown in FIG. 4. Specifically, a fixing plate 16 with two engagement members 15 each having a mounting groove 15*a* being opposite to each other is provided. In this case, the base plate 1 of the applicator A is fit between the mounting grooves 15*a* of the locking members 15 and bolted by a fixing bolt 17 provided in the locking members 15 so that it is removable.

Figure 5:
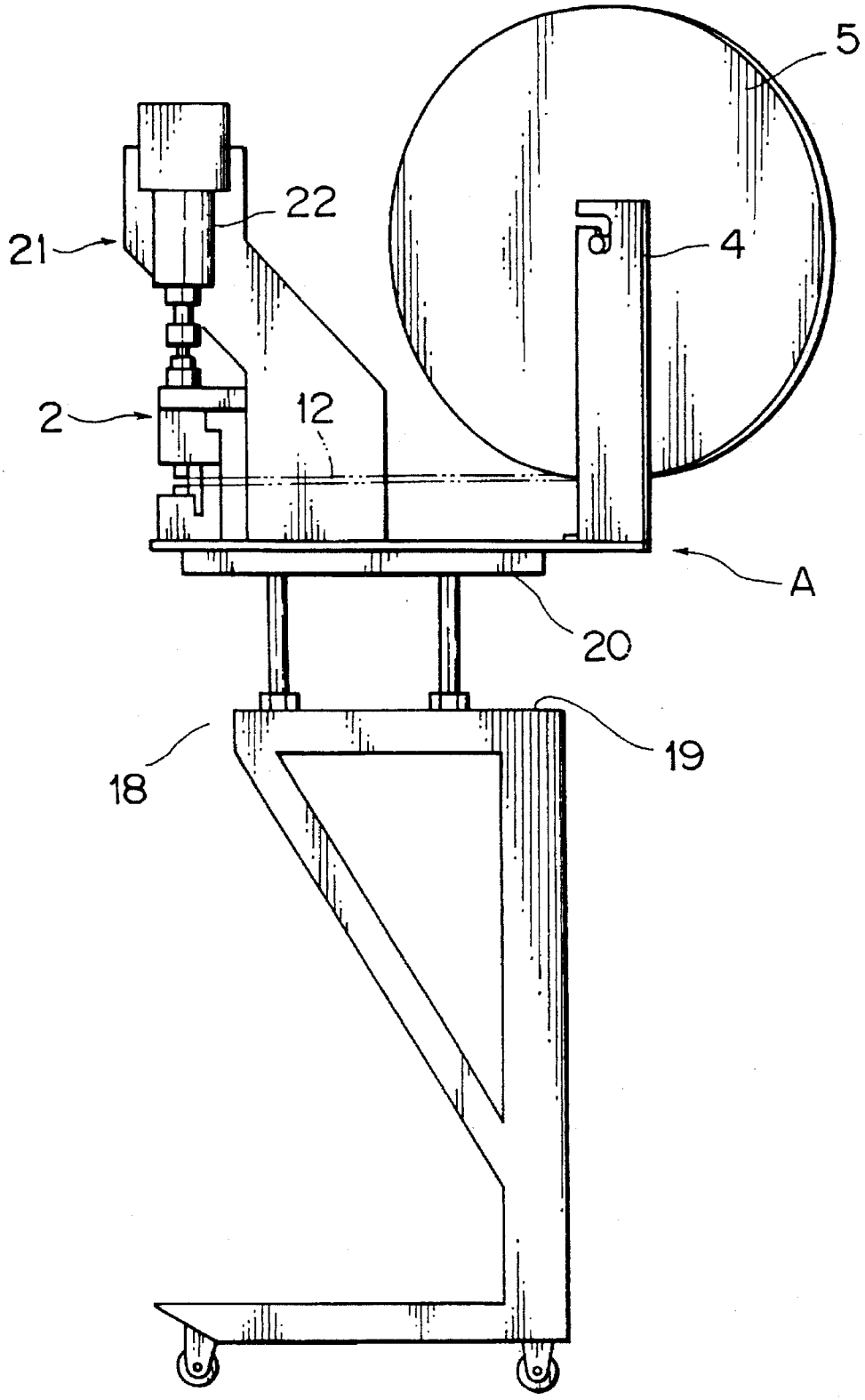
FIG. 5 is a side view showing the state where the applicator for the terminal crimping machine shown in FIG. 1 is mounted in a terminal crimping unit of wires.
Figure 6:
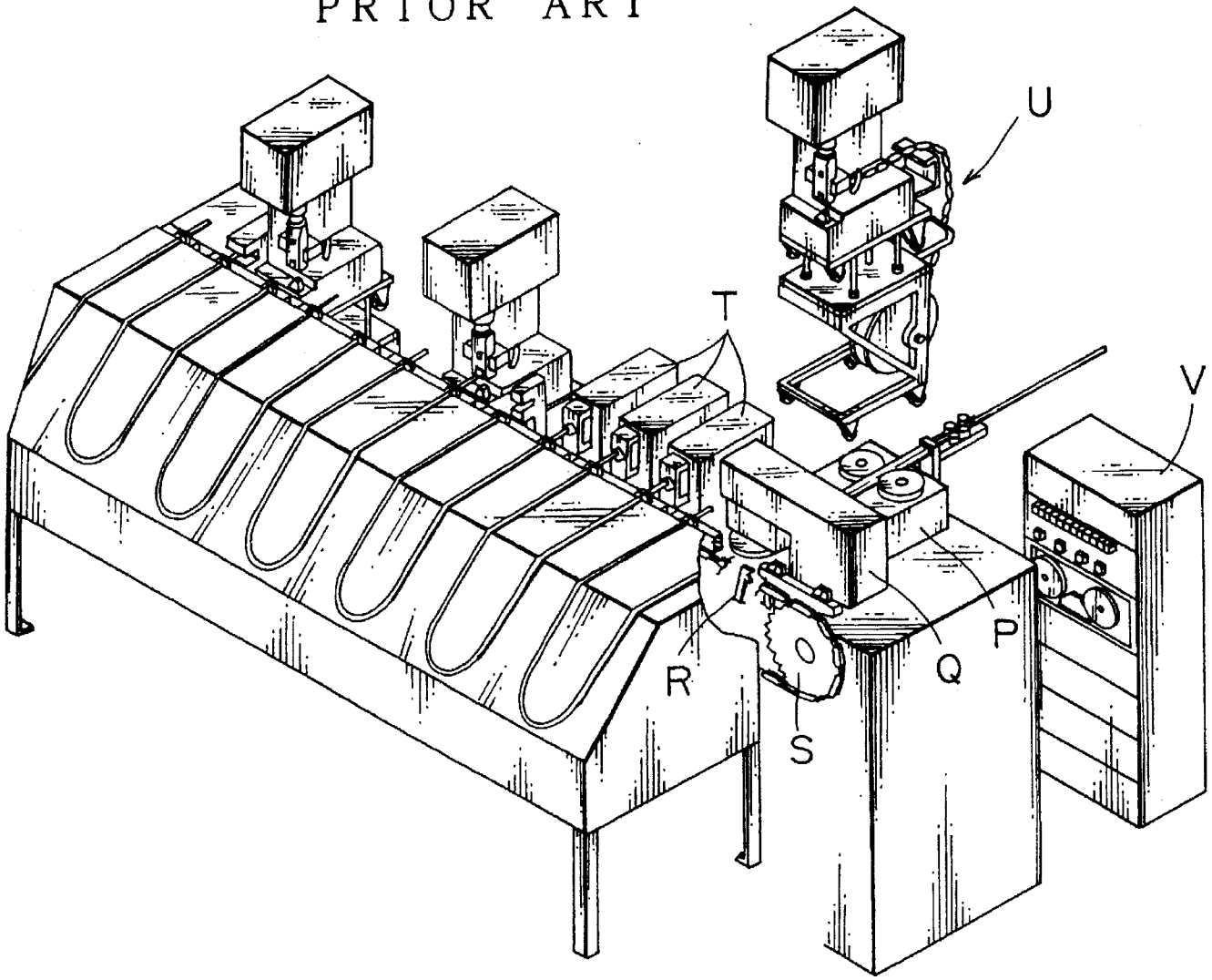
FIG. 6 PRIOR ART
FIG. 6 is a perspective view of the conventional wire end processing device.
Figure 7:
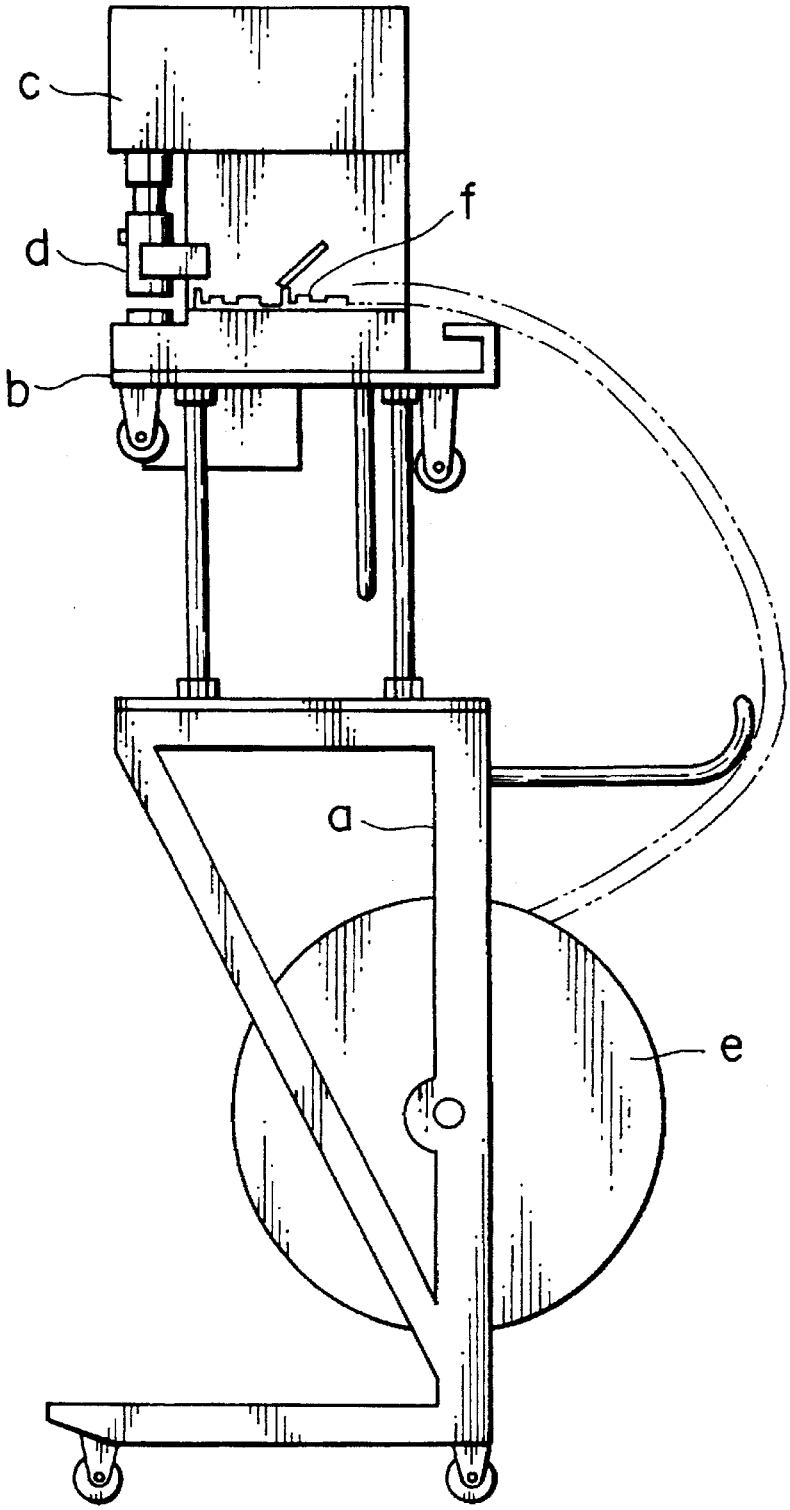
FIG. 7 PRIOR ART
FIG. 7 is a side view of the terminal crimping unit of the wire end processing device shown in FIG. 6.

The terminal crimping machine for mounting the applicator A should not also be limited particularly. As shown in FIG. 5, it is preferable to mount the applicator A in the terminal crimping unit 18 as the wire end processing device for continuously performing crimping of a wire with a terminal.

The terminal crimping unit 18 includes a terminal crimping machine 21 placed on the hooking stand 20 set on the stand 19 which can be freely shifted. The applicator A is mounted removably in such a manner that the terminal crimping portion 2 of the applicator A with the chain-like or crimped terminals 12 previously held is located below the driving section 22 of the terminal crimping machine 21. The work of changing the part number of terminals has only to perform the exchange of the applicator A by attachment/removal.

What is claimed is:

1. An applicator for removably mounting on a terminal crimping machine, said applicator comprising:

a rectangular base plate;

a terminal crimping means for crimping terminals to produce crimped terminals, said terminal crimping means including a crimping anvil and a crimping jig and said terminal crimping means being mounted on a supporting frame and said supporting frame having a bottom portion mounted on a first end of said rectangular base plate;

a terminal supply member having a terminal shifting mechanism, said terminal supply member being provided integrally on said terminal crimping means;

a terminal reel means for taking up said crimped terminals on a take-up line which is wound around said terminal reel means; and a reel stand means for supporting said terminal reel member, wherein said reel stand means is mounted on a second opposing end of said rectangular base plate.

2. The applicator for removably mounting on a terminal crimping machine according to claim 1, wherein said terminal supply member comprises said terminal shifting mechanism which includes a terminal shifting stand, a shifting piece and a terminal shifting arm, wherein said terminal shifting arm is rotatably mounted on said terminal supply member and is engagable with said crimping jig.

3. The applicator for removably mounting on a terminal crimping machine according to claim 1, wherein a longitudinal axis of said terminal reel means for taking-up said crimped terminals on said take-up line wound around said terminal reel means is inclined by a predetermined angle from a longitudinal axis of said reel stand means which is in parallel with said crimping anvil of said terminal crimping means attached at said first end of said rectangular base plate.

4. The applicator for removably mounting on a terminal crimping machine according to claim 3, wherein said predetermined angle is 15°.

5. An applicator for removably mounting on a terminal crimping machine, said applicator comprising:

a terminal crimping member including a crimping anvil and a crimping jig;

a terminal supply member having a terminal shifting mechanism;

a terminal reel member on which crimped terminals on a take-up line are wound; and a reel stand means for supporting said terminal reel;

wherein all of said terminal crimping member, said terminal supply member, said terminal reel member and said reel stand means are integrally arranged on a base plate; and wherein said terminal supply member comprising said terminal shifting mechanism includes a terminal shifting arm which is rotatably mounted on said terminal supply member and which can engage said crimping jig.

6. The applicator for removably mounting on said terminal crimping machine according to claim 5, wherein a longitudinal axis of said terminal reel member for taking up said crimped terminals on said take-up line wound around said terminal reel member is inclined by a predetermined angle from a longitudinal axis of said reel stand means which is in parallel with said anvil of said terminal crimping means mounted on said first end of said rectangular base plate.

7. The applicator for removably mounting on said terminal crimping machine according to claim 6, wherein said predetermined angle is 15°.

8. An applicator for removably mounting on a terminal crimping machine, said applicator comprising:

a terminal crimping member including a crimping anvil and a crimping jig;

a terminal supply member having a terminal shifting mechanism;

a terminal reel member on which crimped terminals on a take-up line are wound; and a reel stand means for supporting said terminal reel;

wherein all of said terminal crimping member, said terminal supply member, said terminal reel member and said reel stand means are integrally arranged on a base plate; and wherein a longitudinal axis of said terminal reel member for taking-up said crimped terminals on said take-up line wound around said terminal reel member is inclined at a predetermined angle from a longitudinal axis of said reel stand means which is in parallel with a longitudinal axis of said crimping anvil of said terminal crimping means mounted to said first end of said base plate.

9. The applicator for removably mounting on said terminal crimping machine according to claim 8, wherein said terminal supply member comprises said terminal shifting mechanism including a terminal shifting arm which is rotatable and which can engage said crimping jig.

10. The applicator for removably mounting on said terminal crimping machine according to claim 9, wherein said predetermined angle is 15°.

11. The applicator for removably mounting on said terminal crimping machine according to claim 8, wherein said predetermined angle is 15°.

* * * * *